US006047441A

United States Patent [19]

Moorman

[11] Patent Number: 6,047,441

[45] Date of Patent: Apr. 11, 2000

[54] FLEXIBLE SHEET REINFORCEMENT APPARATUS AND METHOD

[76] Inventor: Robert A. Moorman, 35227 Greenwich Ave., North Ridgeville, Ohio 44039

[21] Appl. No.: 09/070,326

[22] Filed: Apr. 30, 1998

Related U.S. Application Data

[60] Provisional application No. 60/058,291, Sep. 9, 1997.

[51] Int. Cl.[7] ..... F16L 5/00

[52] U.S. Cl. ..... 16/87.2; 16/2.1; 24/713.6

[58] Field of Search ..... 16/87.2, 2.1; 24/713.6

[56] References Cited

U.S. PATENT DOCUMENTS

| | | | |
|---|---|---|---|
| 2,807,850 | 10/1957 | Davidson | 24/713.6 |
| 5,069,586 | 12/1991 | Casey | 411/339 |
| 5,111,868 | 5/1992 | Sawaya | 160/330 |
| 5,222,988 | 6/1993 | Riley | 16/2.1 |
| 5,339,884 | 8/1994 | Angerman | 160/330 |
| 5,647,107 | 7/1997 | Brewster | 24/713.6 |

FOREIGN PATENT DOCUMENTS

| | | | |
|---|---|---|---|
| 603658 | 4/1960 | Italy | 16/87.2 |
| 831563 | 3/1980 | United Kingdom | 16/87.2 |

*Primary Examiner*—Anthony Knight
*Assistant Examiner*—Alison Pickard
*Attorney, Agent, or Firm*—David R. Percio; Daniel D. Wasil

[57] ABSTRACT

A flexible sheet reinforcing apparatus (10) reinforces holes and tears in flexible sheets such as curtains, covers and tarpaulins. The reinforcing apparatus includes a first member (12) and a second member (14). Reinforcing is accomplished by inserting a first connector (30) through a hole into a second connector (50). Reinforcements (20) reinforce the flexible sheet around the hole. For repair of a shower curtain or tarpaulin or providing a grommet, first connector (30) has a hollow shaft (32) and second connector (50) has a hollow tube (52) through which a shower curtain hook, tie down or other device may be inserted. The repaired curtain or tarpaulin or the grommet is ready for its next use. Flexible sheet reinforcing apparatus (10) may be used through two or more sheets having registering holes. Flexible sheet reinforcing apparatus (10) may be removed for use in a different repair or grommet application.

14 Claims, 3 Drawing Sheets

FLEXIBLE SHEET REINFORCEMENT APPARATUS AND METHOD

This application claims benefit of provisional application Ser. No. 60/058291 filed Sep. 9, 1997.

This invention relates to reinforcement apparatus and methods. Specifically this invention relates to a reinforcement apparatus and method for flexible sheets, and particularly for sheet goods such as those used as shower curtains, tarpaulins or covers.

BACKGROUND ART

A common use of flexible sheets is for curtains and more particularly, for example, shower curtains. Another common use is for tarpaulins and covers. The thickness of the sheet is relatively thin compared to its other two dimension, namely height and width. Punctures of the flexible sheet may occur during handling or storage, but most often damage occurs during end use as a product.

One method for holding curtains uses a number of holes or apertures near the top or support edge of the sheet. A shower curtain is one example of a curtain having holes at or near one edge. In a standard shower curtain holes are available for the placement of hooks for supporting the shower curtain from a curtain rod. One method for holding tarpaulins or covers uses a number of holes or apertures near the perimeter of the sheet. The holes or apertures in the tarpaulin or cover are available for insertion of fastening or tie down devices.

An example of an embodiment of the invention is used in connection with a flexible sheet used as a shower curtain. Shower curtains are often made of flexible plastic or similar waterproof material. After a period of use, the holes through which the hooks are inserted become stretched or torn. The shower curtain may remain functional with one or more damaged hook holes, but eventually too many holes will be damaged and the shower curtain will sag at inadequately supported points and no longer effectively contain the shower water. Also, a shower curtain with damaged holes is not aesthetically pleasing.

The user has two alternatives for dealing with a shower curtain with torn hook holes. First, the user may discard the shower curtain. Second, the user may continue to use the damaged shower curtain. There are drawbacks associated with both of these alternatives.

The first alternative is undesirable because the shower curtain may be generally functional and to simply discard it could be considered wasteful or inappropriate. Also, it may be difficult to replace a particular style or pattern which was specifically chosen to match other decor. If planned redecorating is imminent, replacement may be inconvenient, particularly if a replacement shower curtain will have to be replaced again as a part of the redecorating.

The second alternative, continuing to use a damaged shower curtain, is also undesirable. If the curtain has only one or a small number of damaged holes, it may remain functional. However, continued use of a damaged shower curtain may negatively affect the appearance of the room. And if the number of damaged holes is large, water may spray into the room defeating the purpose of the shower curtain.

Similar situations arise with other types of flexible sheets such as tarpaulins and covers which have eyes or similar apertures for support or fastening which become torn in the aperture arc. One method for holding tarpaulins or covers uses a number of holes or apertures near the perimeter of the sheet. The tarpaulin or cover may be secured over an item or collection of items to provide protection from weather or other environmental forces, or simply to obscure the item from view.

After a period of use, the holes through which the fastening devices are inserted become stretched or torn. The tarpaulin or cover may remain functional with one or more damaged holes, but eventually too many holes will be damaged and the tarpaulin or cover will no longer effectively cover the item.

The user has two alternatives for dealing with a tarpaulin or cover with torn tie down holes. First, the user may discard the tarpaulin or cover. Second, the user may continue to use the damaged tarpaulin or cover. There are drawbacks associated with both of these alternatives.

The first alternative is undesirable because the tarpaulin or cover may be generally functional and to simply discard it could be considered wasteful or inappropriate. Also, it may be difficult to replace a particular tarpaulin or cover immediately, such as in a remote location or late at night.

The second alternative, continuing to use a damaged tarpaulin or cover, is also undesirable. If the tarpaulin or cover has only one or a small number of damaged holes, it may remain functional. However, continued use of a damaged tarpaulin or cover may negatively affect the ability to cover the item, even to the point of defeating the purpose of using the tarpaulin or cover.

Thus there exists a need for an apparatus and method which permits quick, efficient and convenient reinforcement and repair of shower curtains, tarpaulins or covers.

DISCLOSURE OF INVENTION

It is an object of the present invention to provide an apparatus and method for reinforcement of flexible sheets.

It is a further object of the present invention to provide an apparatus and method for reinforcement of flexible sheets such as covers, tarpaulins and shower curtains.

It is a further object of the present invention to provide an apparatus and method for reinforcement of flexible sheets which can be done quickly, efficiently and conveniently.

It is a further object of the present invention to provide an apparatus and method for reinforcement of sheets of various sizes, and materials.

It is a further object of the present invention to provide an apparatus and method for reinforcement of flexible sheets which have become torn or punctured.

It is a further object of the present invention to provide an apparatus and method for releasably connecting two or more sheets.

It is a further object of the present invention to provide an apparatus and method for a grommet for flexible sheets.

Further objects of the present invention will be made apparent in the following Best Mode For Carrying Out Invention and the appended claims.

The foregoing objects are accomplished in a preferred embodiment of the invention by an apparatus and method for reinforcement of the area surrounding a hole or aperture through a sheet.

Reinforcement is placed on opposite sides of the flexible sheet around the hole. The reinforcement may be any shape or size to conveniently cover the area. The reinforcement may also contain a hole through which a hook or tie down may pass, thereby replacing the original hole.

The reinforcement may be removable. This will allow it to be reclaimed when the flexible sheet is no longer to be used.

The present invention enables repair of a flexible sheet having holes for support or fastening by placing reinforcement around the hole and allowing a hook to pass through the repaired area for resuming use of a hook to hang or a tie down to fasten the flexible sheet. The damaged flexible sheet is quickly, conveniently and efficiently reinforced and repaired, making it ready for use again.

BEST MODE FOR CARRYING OUT INVENTION

Figure 1:
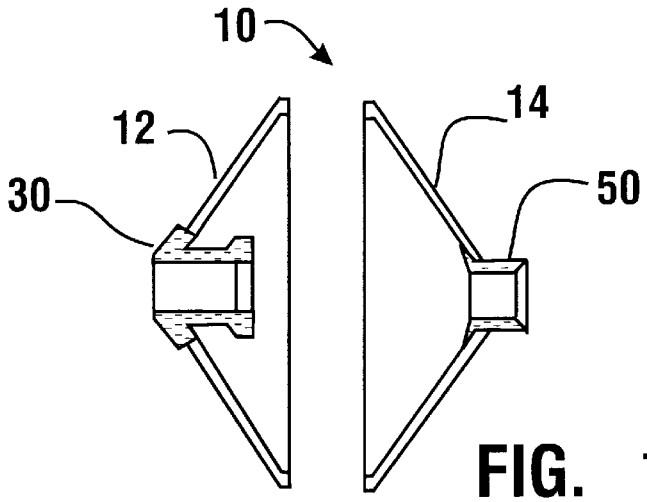
FIG. 1 is a cross-sectional view of a preferred embodiment of the flexible sheet reinforcement apparatus of the present invention.

Referring now to the drawings and particularly to FIG. 1, there is shown therein a preferred embodiment of a flexible sheet reinforcing apparatus of the present invention, generally indicated 10. One use of the preferred embodiment is for a shower curtain repair. However, it should be understood that the present invention may be used to reinforce or repair other types of flexible sheets which include eyes, holes or apertures for connection to supports, anchors, ropes, hooks or similar members.

Flexible sheet reinforcing apparatus 10 has a first member 12 and a second member 14. Each of first member 12 and second member 14 includes a reinforcement 20. First member 12 includes a first connector 30. Second member 14 includes a second connector 50. It should be understood that although the first and second connectors are separate members in the embodiment shown, in other embodiments they may be integrally formed with other components. In the preferred embodiment the reinforcements 20, first member 12, second member 14, first connector 30 and second connector 50 are comprised of resilient plastic material. However, in other embodiments other types of materials may be used.

Figure 2:
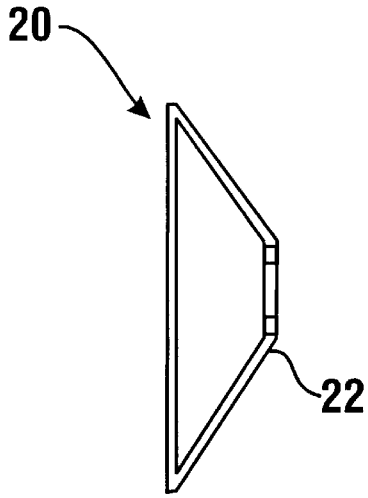
FIG. 2 is a side view of a concave reinforcement.
Figure 3:
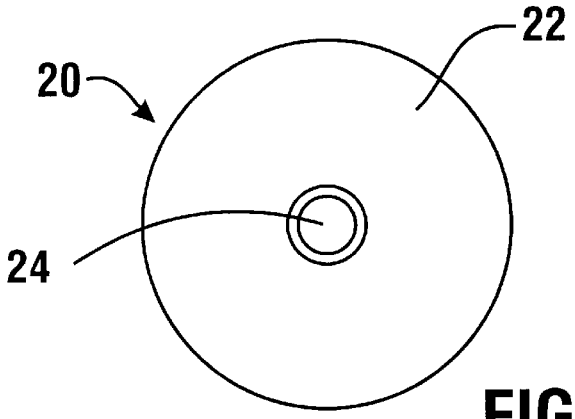
FIG. 3 is a top view of a concave reinforcement.

Shown in FIG. 2 is side view and shown in FIG. 3 is a top view of a reinforcement 20. In the preferred embodiment of the invention reinforcement 20 has a concave, suction cup shaped concave wall 22 having an outside diameter of approximately ¾". Cupped wall 22 has an aperture 24 located more or less concentrically therein. Aperture 24 has a generally circular shape with a diameter of approximately ¼". However it should be understood that the present invention may be used with variously shaped reinforcements.

Figure 4:
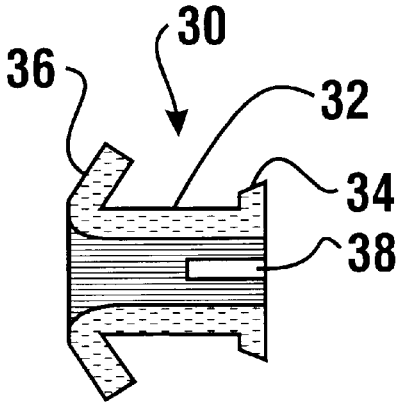
FIG. 4 is a side view of a first connector.
Figure 5:
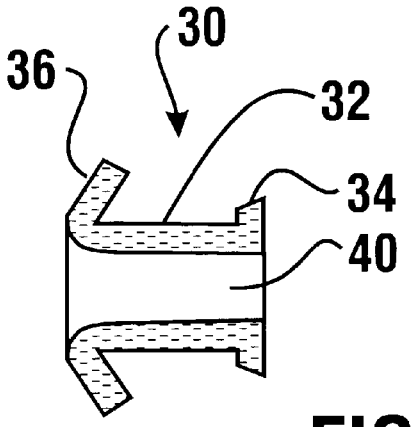
FIG. 5 is a cross-sectional view of the first connector shown in FIG. 4.

As shown in FIGS. 4 and 5 first connector 30 has a shaft 32. At one end of shaft 32 is a ridge 34. At a second end of shaft 32 is a rim 36. Shaft 32 further has one or more slits 38.

In the preferred embodiment for use with a shower curtain as would be found in a home, shaft 32 includes lumen 40 which extends between ridge 34 and rim 36, whereby shaft 32 is hollow. The outside diameter of shaft 32 is approximately ¼". The outside diameter of shaft 32 is approximately the same as the diameter of aperture 24 to allow attachment of shaft 32 within aperture 24. As shown in FIG. 1 rim 36 limits the extent to which shaft 32 may pass through aperture 24 into the partially enclosed concave area of cupped wall 22.

Shaft 32 has an inside diameter is approximately 3/16". Shaft 32 has two slits 38 extending longitudinally from ridge 34 approximately half way to rim 36. The width and length of slit 38 may be varied to obtain suitable operation. Slits 38 are positioned approximately 180° apart on the circumference of shaft 32 and facilitate deformation of shaft 32. In other embodiments shaft 32 may be only partially hollow or it may be solid.

Figure 6:
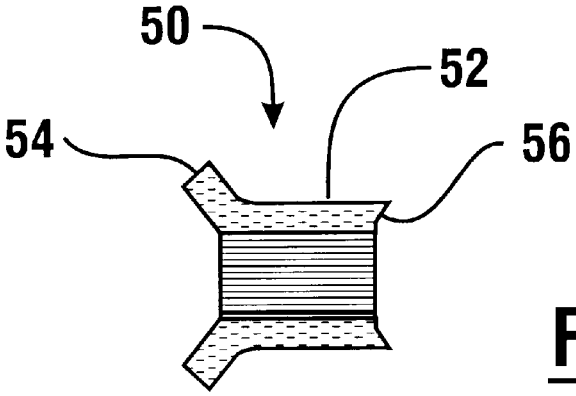
FIG. 6 is a side view of a second connector.
Figure 7:
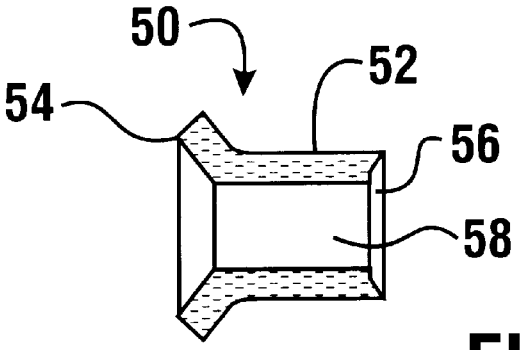
FIG. 7 is a cross-sectional view of the second connector shown in FIG. 6.

As shown in FIGS. 6 and 7 second connector 50 has a tube 52. At one end of tube 52 is lip 54. At a second end of tube 52 is groove 56.

In the preferred embodiment tube 52 includes lumen 58 which extends between lip 54 and groove 56, whereby tube 52 is hollow. The outside diameter of tube 52 is approximately ¼". The outside diameter of tube 52 is approximately the same as the diameter of aperture 24 to allow attachment of tube 52 within aperture 24. As shown in FIG. 1 lip 54 limits tube 52 from passing through aperture 24 outward from the partially enclosed concave area of cupped wall 22. Cupped wall 22 may be of any convenient diameter. Tube 52 has an inside diameter is approximately 3/16".

The flexible sheet reinforcement method of the present invention includes the steps of positioning first member 12 and second member 14 on opposite sides of a flexible sheet surface having a hole through it, and connecting first connector 30 and second connector 50 through the hole to each other.

Using the preferred embodiment of the invention shown in FIG. 1 for repair of a hole in a sheet, specifically a shower curtain ring hole, first member 12 is positioned with first connector 30 on one side of the flexible sheet near the hole. Second member 14 is positioned on the opposite side of the flexible sheet.

First connector 30 is inserted through the hole. Lip 54 is positioned near ridge 34. Opposing forces are simultaneously applied around aperture 24 in the areas of rim 36 and groove 56. The forces cause shaft 32 to be urged into tube 52.

The outside diameter of ridge 34 is larger than the inside diameter of tube 52. As ridge 34 is displaced within tube 52, slits 38 are compressed reducing the effective outside diameter of ridge 34. This permits ridge 34 to be displaced within tube 52. The forces also deform cupped walls 22 into a planar shape thereby creating a partial vacuum, as is commonly known to occur with suction cups, between the interior surface of cupped wall 22 and the adjacent surface of the shower curtain.

When ridge 34 passes through the end of tube 52 at groove 56, the larger diameter of groove 56 allows ridge 34 to return to the shape it had before it was deformed. Ridge 34 is held in position by groove 56.

Figure 8:
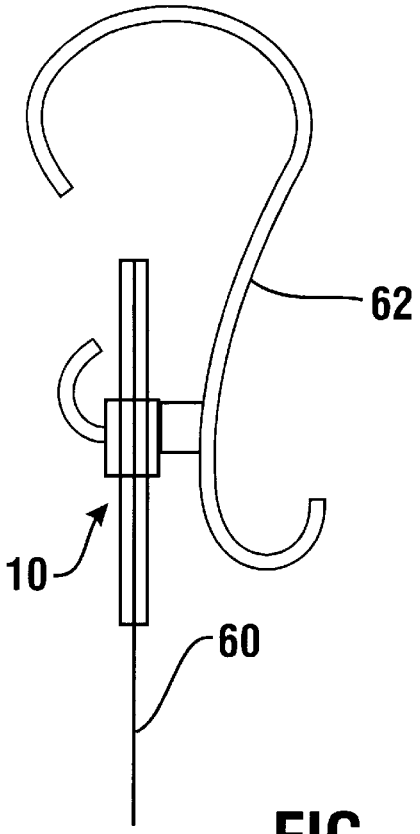
FIG. 8 is a cross-sectional view of the flexible sheet reinforcing apparatus on a shower curtain supported by a curtain hook.

As shown in FIG. 8 the method of the present invention permits repair of shower curtain 60. Cupped walls 22 provide additional reinforcement of the shower curtain hole area. A shower curtain hook 62 may be inserted through shaft 32 to hang shower curtain 60 in the normal way.

Flexible sheet reinforcing apparatus 10 may be removed from shower curtain 60 by applying a force in a direction opposite the direction of the installation force.

Figure 9:
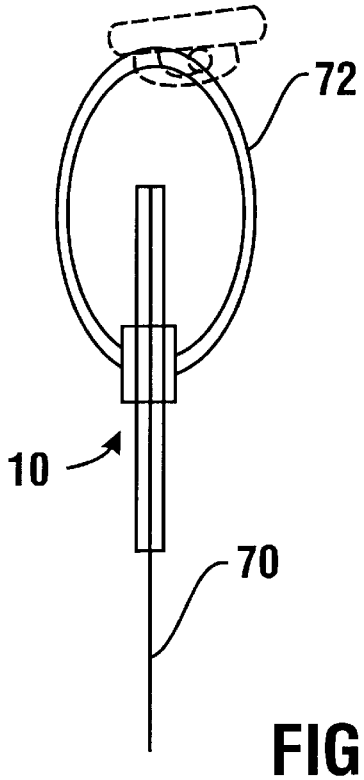
FIG. 9 is a cross-sectional view of the flexible sheet reinforcing apparatus on a tied down tarpaulin or cover.

As shown in FIG. 9 the method of the present invention permits repair of cover or tarpaulin 70. Cupped walls 22 provide additional reinforcement of the cover or tarpaulin hole area. A tie down device 72 may be inserted through hollow shaft 32 and tube 52 to hang cover or tarpaulin 70 in the normal way. Flexible sheet reinforcing apparatus 10 may be removed from cover or tarpaulin 70 by applying a force in a direction opposite the direction of the installation force.

Figure 10:
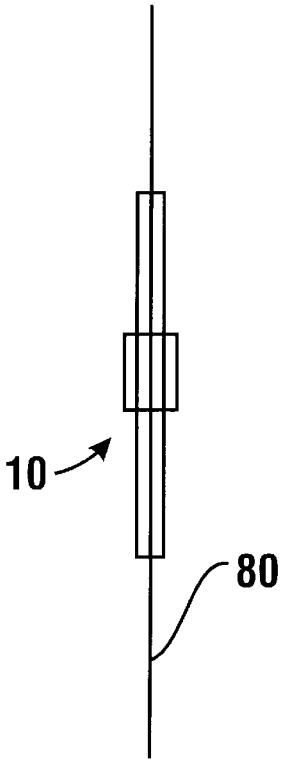
FIG. 10 is a cross-sectional view of the flexible sheet reinforcing apparatus as a grommet.

As shown in FIG. 10 the method of the present invention permits placement of a grommet in a flexible sheet 80. Cupped walls 22 provide additional reinforcement of the flexible sheet hole. Any desired item of appropriate size may be inserted through hollow shaft 32 and hollow tube 52. The grommet thus formed by flexible sheet reinforcing apparatus 10 may be removed from flexible sheet 80 by applying a force in a direction opposite direction of the installation force.

As will be appreciated by one skilled in the art, the apparatus and method of the present invention may be used to reinforce sheets of varying thicknesses and having holes of varying sizes and shapes. Further, the apparatus and method of the present invention may be used through two or more sheets having registering holes.

Flexible sheet reinforcing apparatus 10 may be transparent or any color or combination of colors. It can be used to repair torn or damaged sheets and it can be used to reinforce holes in a new sheet to extend the useful life of the flexible sheet. It can also be used as a grommet by making a hole in a flexible sheet at a desired location and installing it as described above.

Thus the new flexible sheet reinforcing apparatus and method of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

I claim:

1. An apparatus for reinforcing a flexible sheet, the sheet having a first side, a second side and a hole from the first side to the second side, the apparatus comprising:

a first reinforcement bounding the hole on the first side;

a second reinforcement bounding the hole on the second side opposite the first reinforcement;

a first connector in attached relation with the first reinforcement;

a second connector in attached relation with the second reinforcement, wherein the first connector and the second connector releasable connect through the hole;

wherein the first and second reinforcements each have an inside surface and an outside surface wherein the inside surface is in concave relation with the outside surface; and wherein the first and second reinforcements each have an aperture therethrough.

2. The apparatus of claim 1 wherein the first and second reinforcements each have a perimeter bounding the inside surface and the outside surface.

3. The apparatus of claim 2 wherein the perimeter is circular.

4. The apparatus of claim 1 wherein the first connector is bounded by the aperture through the first reinforcement and the second connector is bounded by the aperture through the second reinforcement.

5. The apparatus of claim 4 wherein the first connector comprises a shaft having a first end and a second end, the shaft first end having a ridge, and wherein the second connector comprises a tube having a first end and a second end, the tube first end having a groove, the tube further having a lumen from the tube first end to the tube second end.

6. The apparatus of claim 5 wherein the ridge engages the groove to oppose displacement of the shaft from the tube.

7. The apparatus of claim 6 wherein the shaft second end has a rim and the tube second end has a lip.

8. An apparatus for reinforcing a flexible sheet, the sheet having a first side, a second side and a hole from the first side to the second side, the apparatus comprising:

a first reinforcement bounding the hole on the first side;

a second reinforcement bounding the hole on the second side opposite the first reinforcement;

a first connector in attached relation with the first reinforcement;

a second connector in attached relation with the second reinforcement, wherein the first connector and the second connector releasably connect through the hole;

wherein the first and second reinforcements each have an aperture therethrough;

wherein the first connector is bounded by the aperture through the first reinforcement and the second connector is bounded by the aperture through the second reinforcement;

wherein the first connector comprises a shaft having a first end and a second end, the shaft first end having a ridge, and wherein the second connector comprises a tube having a first end and a second end, the tube first end having a groove, the tube further having a lumen from the tube first end to the tube second end;

wherein the ridge engages the groove to oppose displacement of the shaft from the tube; and wherein the shaft second end has a rim and the tube second end has a lip.

9. The apparatus of claim 8 wherein the lip aligns the ridge with the lumen.

10. The apparatus of claim 9 wherein the ridge interlocks with the groove.

11. The apparatus of claim 10 wherein the shaft has a longitudinal slit.

12. The apparatus of claim 11 wherein the slit extends longitudinally in the shaft.

13. The apparatus of claim 12 wherein the shaft has a lumen from the shaft first end to the shaft second end.

14. A method for reinforcing a flexible sheet, the sheet having a first side, a second side and a hole from the first side to the second side, the method comprising:

attaching a first reinforcement to the sheet, the first reinforcement bounding the hole on the first side, wherein the first reinforcement has an aperture therethrough;

attaching a second reinforcement to the sheet, the second reinforcement bounding the hole on the second side, wherein the second reinforcement has an aperture therethrough;

releasably attaching the first reinforcement to the second reinforcement through the hole;

attaching a first connector in relation with the first reinforcement, wherein the first connector is bounded by the aperture through the first reinforcement, and wherein the first connector comprises a shaft having a first end and a second end, the shaft first end having a ridge and the shaft second end having a rim;

attaching a second connector in relation with the second reinforcement, wherein the second connector is bounded by the aperture through the second reinforcement, and wherein the second connector comprises a tube having a first end and a second end, the tube first end having a groove and the tube second end having a lip, the tube further having a lumen from the tube first end to the tube second end; and releasably connecting the first connector and the second connector through the hole, wherein the ridge engages the groove to oppose displacement of the shaft from the tube.

* * * * *